US008779308B2

(12) United States Patent
Takemae et al.

(10) Patent No.: US 8,779,308 B2
(45) Date of Patent: Jul. 15, 2014

(54) KEY SWITCH DEVICE AND KEYBOARD

(75) Inventors: Akihiko Takemae, Shinagawa (JP); Norio Endo, Shinagawa (JP); Shuji Nakamura, Shinagawa (JP); Tamotsu Koike, Shinagawa (JP); Takeshi Nishino, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 219 days.

(21) Appl. No.: 13/367,752

(22) Filed: Feb. 7, 2012

(65) Prior Publication Data

US 2012/0199458 A1 Aug. 9, 2012

(30) Foreign Application Priority Data

Feb. 7, 2011 (JP) ..... 2011-024312
Jun. 10, 2011 (JP) ..... 2011-130308

(51) Int. Cl.

| | |
|---|---|
| ***H01H 9/26*** | (2006.01) |
| ***H01H 3/12*** | (2006.01) |
| ***H01H 13/36*** | (2006.01) |
| ***H01H 13/14*** | (2006.01) |

(52) U.S. Cl.

CPC ..... *H01H 3/125* (2013.01); *H01H 2203/038* (2013.01); *H01H 13/36* (2013.01); *H01H 13/14* (2013.01)

USPC ..... 200/5 A; 200/344; 200/341; 200/517

(58) Field of Classification Search

CPC ..... H01H 3/125; H01H 2203/038; H01H 2215/012; H01H 2237/00; H01H 13/36; H01H 13/02; H01H 13/14

USPC ..... 200/344, 517, 341, 5 A; 400/490, 491, 400/495; 345/168, 169

See application file for complete search history.

(56) References Cited

U.S. PATENT DOCUMENTS

| | | | | |
|---|---|---|---|---|
| 7,973,254 | B2 * | 7/2011 | Yeh et al. | 200/344 |
| 8,207,465 | B2 * | 6/2012 | Maruyama et al. | 200/344 |
| 2006/0000694 | A1 * | 1/2006 | Nishino et al. | 200/5 A |
| 2009/0078552 | A1 * | 3/2009 | Takemae et al. | 200/344 |
| 2009/0103964 | A1 * | 4/2009 | Takagi et al. | 400/495 |

FOREIGN PATENT DOCUMENTS

| | | |
|---|---|---|
| JP | 5-66832 | 9/1993 |
| JP | 9-27235 | 1/1997 |
| JP | 2009-76321 | 4/2009 |

* cited by examiner

*Primary Examiner* — Kyung Lee
(74) *Attorney, Agent, or Firm* — Staas & Halsey LLP

(57) ABSTRACT

A key switch device including a key top; a pair of link members connected to the key top and interlocked with each other to guide a vertical motion of the key top; a switch mechanism including a membrane sheet switch capable of opening and closing a contact section of an electrical circuit in accordance with the vertical motion of the key top; a flexible thin film sheet attached to the membrane sheet switch; and a housing attached to the thin film sheet, the housing adapted to connect the link members to the thin film sheet.

13 Claims, 18 Drawing Sheets

KEY SWITCH DEVICE AND KEYBOARD

CROSS-REFERENCE TO RELATED APPLICATIONS

This application is based upon and claims the benefit of priority from prior Japanese Patent Application Nos. 2011-024312 and 2011-130308 filed on Feb. 7, 2011 and Jun. 10, 2011, respectively, the entire contents of which are incorporated herein by reference.

BACKGROUND OF THE INVENTION

1. Field of the Invention

The present invention relates to a key-entry type switch device (hereinafter referred to as a key switch device) subjected to a key-entry operation, and more particularly to a key switch device which may preferably be used for a keyboard incorporated as an input device in electronic equipment. The present invention also relates to a keyboard provided with a plurality of key switch devices.

2. Description of the Related Art

A thin or low-profile type keyboard has been incorporated in, for example, a notebook type personal computer or other electronic apparatuses. The keyboard is provided with a plurality of key switch devices for a key-entry operation. For example, a gear link-type key switch device is provided with a support plate, a key top arranged above the support plate, a pair of link members connected to the key top and interlocked with each other to guide a vertical or upward-and-downward motion of the key top above the support plate, and a membrane sheet switch capable opening and closing a contact section of an electrical circuit in accordance with the vertical motion of the key top. The link members are secured to the support plate by, for example, a frame-shaped housing. The support plate is attached at the front surface thereof to the back surface of the membrane sheet switch.

For example, Japanese Unexamined Patent Publication (Kokai) No. 2009-76321 (JP2009-76321A), Japanese Unexamined Utility Model Publication (Kokai) No. 5-66832 (JP5-66832U), and Japanese Unexamined Patent Publication (Kokai) No. 9-27235 (JP9-27235A) describe conventional key switch devices.

In the conventional key switch device, the support plate is formed from a metal material, such as a sheet metal or a stainless steel. Therefore, the support plate must have rigidity sufficient to prevent permanent deformation or breakage even when, for example, the support plate is subjected to a stress during the manufacturing or transporting process of a keyboard. Otherwise, a keyboard having a permanently deformed or broken support plate cannot be used as a finished product. Therefore, the support plate is required to have a certain extent of thickness for ensuring the rigidity. However, the thickness may impede reduction in weight and height of a key switch device.

SUMMARY OF THE INVENTION

It is desired to provide a key switch device and a keyboard, which can be reduced in weight and height thereof.

One aspect of the present invention provides a key switch device comprising a key top; a pair of link members connected to the key top, the pair of link members interlocked with each other to guide a vertical motion of the key top; a switch mechanism including a membrane sheet switch capable of opening and closing a contact section of an electrical circuit in accordance with the vertical motion of the key top; a flexible thin film sheet attached to the membrane sheet switch; and a housing attached to the thin film sheet, the housing adapted to connect the link members to the thin film sheet.

According to the above configuration, the housing is attached to the flexible thin film sheet, and the thin film sheet can be flexibly deformed at the time of, for example, assembling the keyboard, so that the permanent deformation or breakage of the thin film sheet can be avoided. The thin film sheet does not require a high rigidity, so that the thickness of the thin film sheet can be extremely reduced. Therefore, it is possible to provide a key switch device or a keyboard, which can be reduced in weight and height, in comparison with a configuration in which a support plate formed from a metal material, such as a sheet metal or a stainless steel, is attached to a membrane sheet switch.

Another aspect of the present invention provides a key switch device comprising a key top; a pair of link members connected to the key top, the pair of link members interlocked with each other to guide a vertical motion of the key top; a switch mechanism including a membrane sheet switch capable of opening and closing a contact section of an electrical circuit in accordance with the vertical motion of the key top; and a housing attached to the membrane sheet switch, the housing adapted to connect the link members to the membrane sheet switch.

A further aspect of the present invention provides a keyboard comprising a plurality of key switch devices, each key switch device being defined above.

BRIEF DESCRIPTION OF THE DRAWINGS

The above and other objects, features and advantages of the present invention will become more apparent from the following description of the embodiments in connection with the accompanying drawings, wherein.

DESCRIPTION OF THE EMBODIMENT

Figure 1:
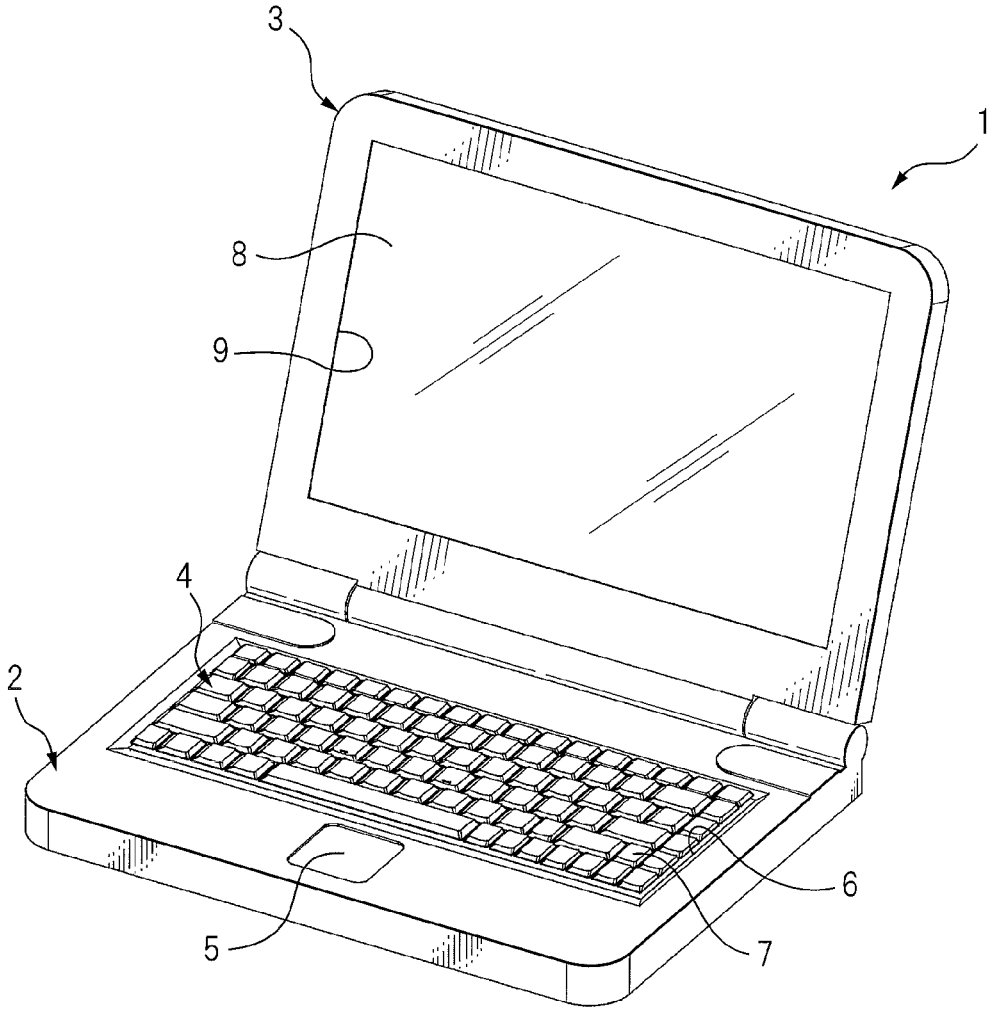
FIG. 1 is a perspective view schematically depicting an external appearance of a notebook type personal computer as a specific example of electronic equipment.

The embodiments of the present invention are described below, in detail, with reference to the accompanying drawings. In the drawings, the same or similar components are denoted by common reference numerals.

Referring to the drawings, FIG. 1 is a perspective view schematically depicting an external appearance of a notebook type personal computer 1 (hereinafter referred to as a "notebook personal computer 1"), as a specific example of electronic equipment. The notebook personal computer 1 is provided with a low-profile main housing 2 and a display housing 3 pivotably connected to the main housing 2. Input devices, such as a keyboard 4 and a pointing device 5, are assembled on the surface of the main housing 2. The keyboard 4 is, for example, fit into an opening 6 formed in the surface of the main housing 2. The keyboard 4 is provided with a plurality of key switch devices 7. The key switch devices 7 are arranged in a predetermined array in a common single plane defined on the keyboard 4.

In the display housing 3, for example, an LCD (liquid crystal display) panel module 8 is assembled. The screen of the LCD panel module 8 is located inside a window 9 formed in the display housing 3. A user operating the notebook personal computer 1 can confirm the operation of the notebook personal computer 1 based on a text or graphics displayed on the screen of the LCD panel module 8. The display housing 3 may be laid on the main housing 2 by rotating the display housing 3 relative to the main housing 2. The notebook personal computer 1 may be folded by laying the display housing 3 on the main housing 2.

Figure 2:
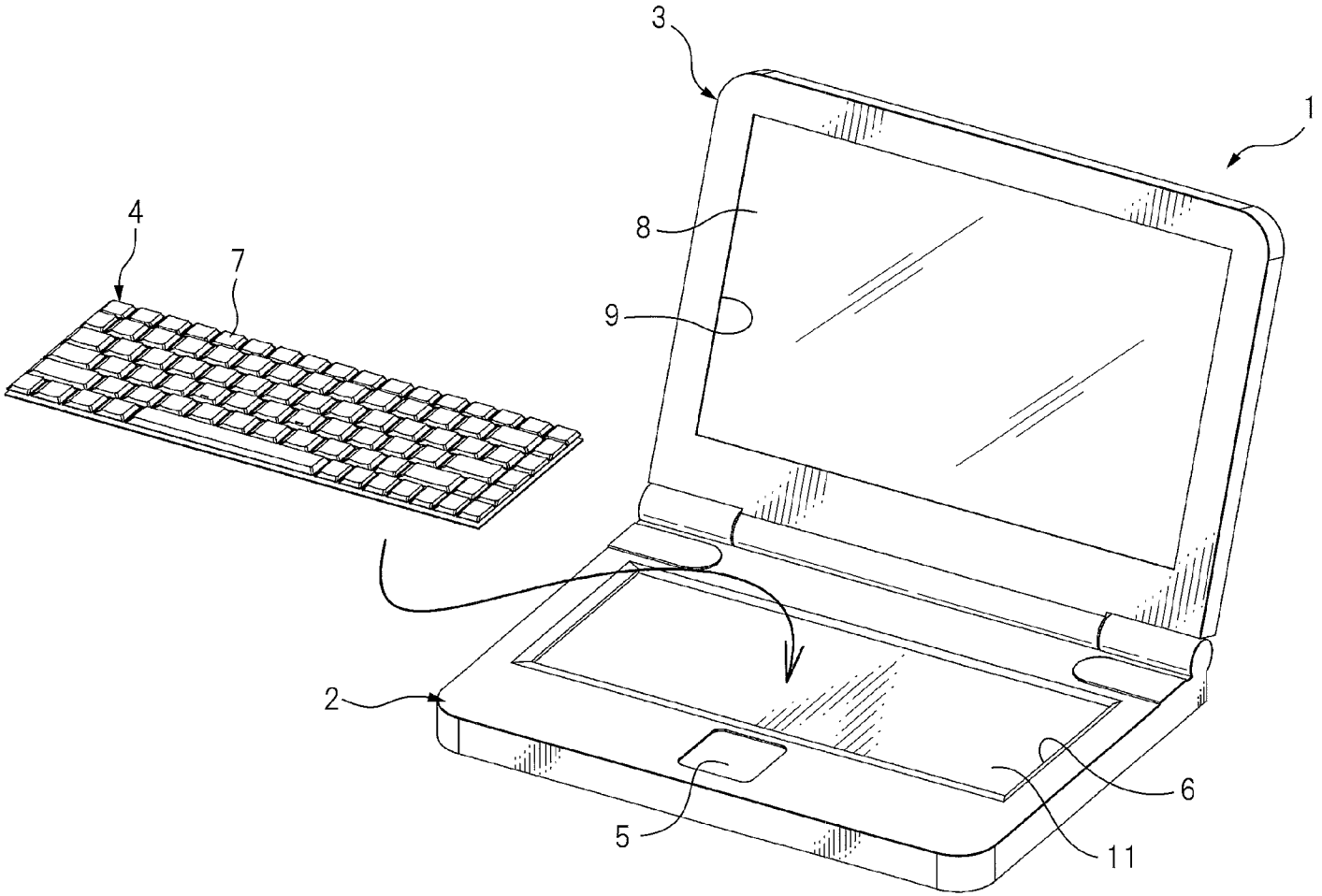
FIG. 2 is an exploded perspective view of a notebook type personal computer, in which a keyboard is detached from a main housing.

FIG. 2 is an exploded perspective view of the notebook personal computer 1, in which the keyboard 4 is detached from the main housing 2. As clearly depicted in FIG. 2, the keyboard 4 is secured to a support plate 11 arranged in the opening 6 of the main housing 2. The support plate 11 has a flat upper surface. Due to the flat surface of the support plate 11, the flatness of the keyboard 4 can be ensured. The support plate 11 may be formed from a metal material, such as a stainless steel, or a resinous material, such as a plastic. For securing the keyboard 4, for example, a plurality of screws (not shown) may be used. The screws may be screwed into the support plate 11 via through holes (not shown) formed in the keyboard 4.

Figure 3:
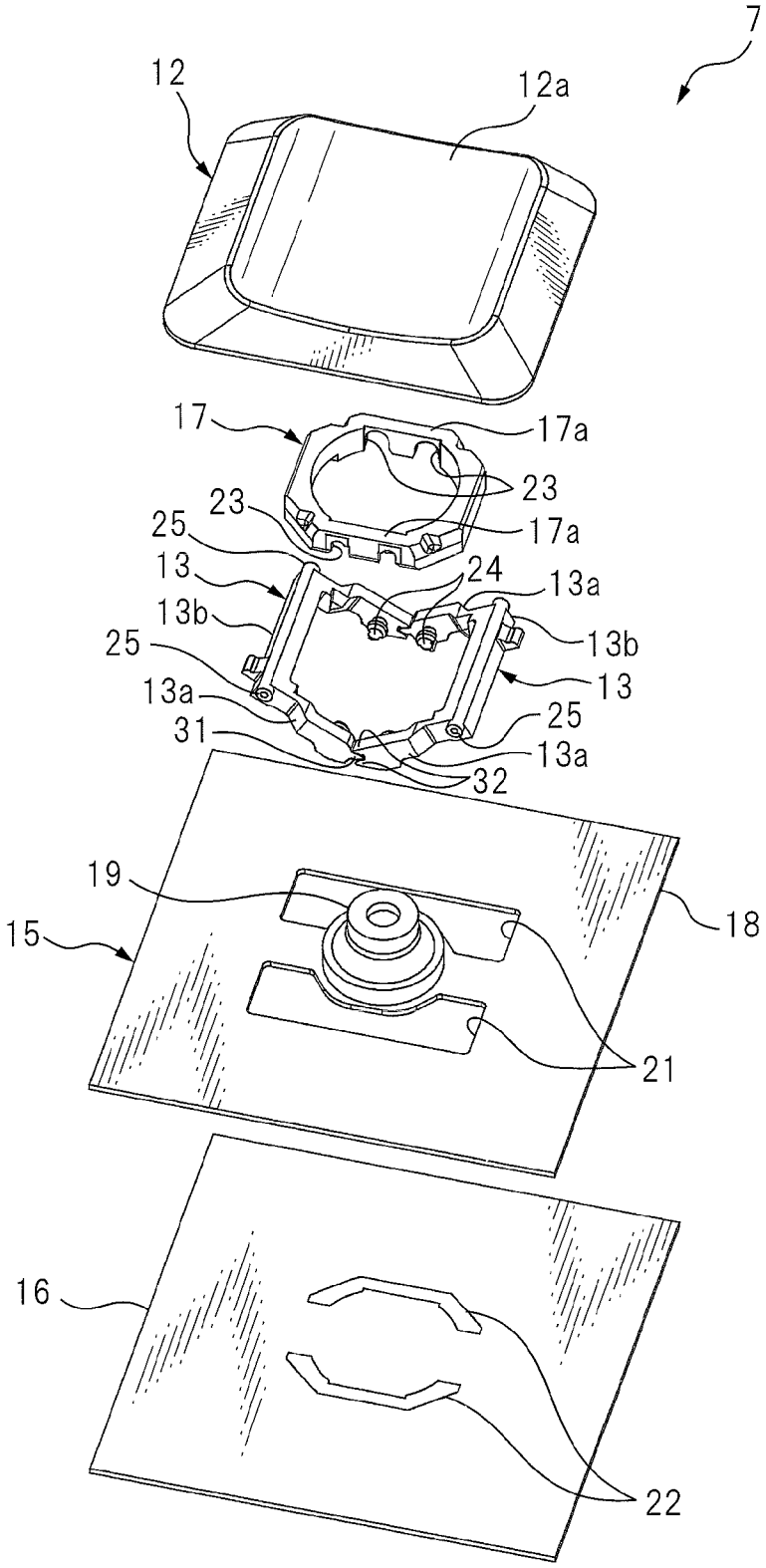
FIG. 3 is an exploded perspective view schematically depicting a key switch device according to a first embodiment.
Figure 4:
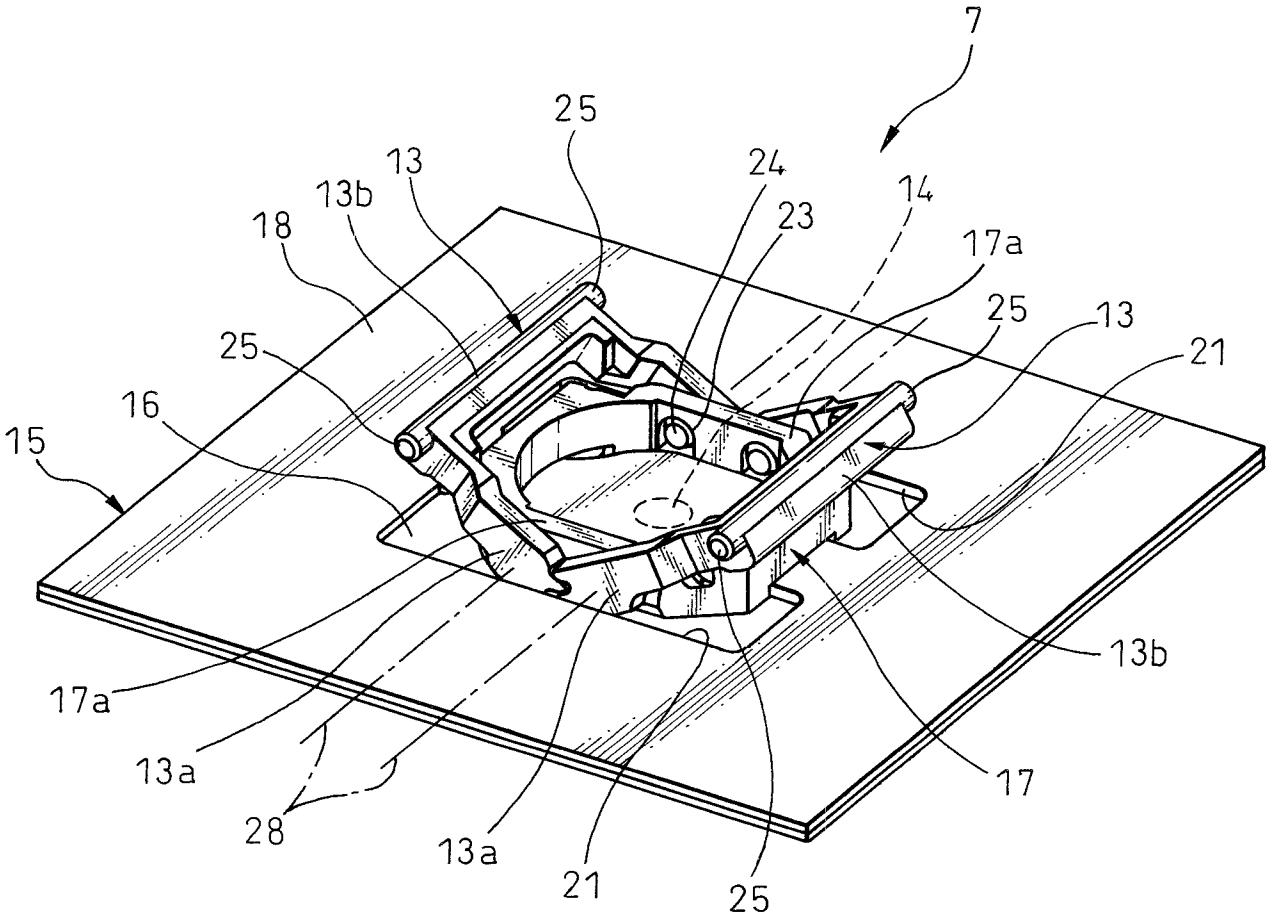
FIG. 4 is an assembled perspective view schematically depicting a part of the key switch device according to the first embodiment.

FIG. 3 is an exploded perspective view schematically depicting a key switch device 7 according to a first embodiment. FIG. 4 is an assembled perspective view schematically depicting a part of the key switch device 7 according to the first embodiment. As depicted in FIGS. 3 and 4, the key switch device 7 is provided with a key top 12, a pair of link members 13, 13 connected to the key top 12 and interlocked with each other to guide a vertical or upward-and-downward motion of the key top 12, a switch mechanism 15 capable of opening and closing a contact section 14 of an electrical circuit in accordance with the vertical motion of the key top 12, a flexible thin film sheet 16 provided with an upper surface adapted to receive the switch mechanism 15, and a housing 17 adapted to connect the link members 13, 13 to the thin film sheet 16.

The key top 12 is a dish-like component having a rectangular shape as seen in a plan view. The key top 12 is provided on its top surface with an operating surface 12*a* subjected to a key-entry operation by a user operating the notebook personal computer 1. The housing 17 is a frame-like component having a rectangular profile as seen in a plan view. The link members 13, 13 have shapes and dimensions identical to each other. The link members 13, 13 are meshed in a gearing manner at the first ends thereof with each other and thus assembled together in an interlockable manner. The link members 13, 13 have a V-shaped gear link configuration showing a V-shape as seen in a side view when the key top 12 is located at the upper limit position of the vertical motion.

The switch mechanism 15 includes a membrane sheet switch 18 carrying the contact section 14 at a position beneath the key top 12, and a rubber dome 19 as an actuating member disposed between the key top 12 and the contact section 14. The flexible thin film sheet 16 is attached to the membrane sheet switch 18. The rubber dome 19 acts to close the contact section 14 in accordance with the downward motion of the key top 12. The membrane sheet switch 18 is provided with relief holes (e.g., a pair of relief holes 21, 21) having shapes identical to each other and arranged at opposite sides of the rubber dome 19. The relief holes 21 are formed to pass through the membrane sheet switch 18. The housing 17 is bonded, at the inside of the relief holes 21, 21, to the top surface of the thin film sheet 16 by, for example, an adhesive 22. The rubber dome 19 is disposed inside the frame-like housing 17.

The key top 12, the housing 17 and the link members 13, 13 may be respectively formed by integrally-molded or unitary components made of a resinous material, such as acrylonitrile-butadiene-styrene (ABS). The membrane sheet switch 18 may be made of a plastic material, such as polyethylene terephthalate (PET). The rubber dome 19 may be made of an elastic resinous material, such as rubber. The thin film sheet 16 may be formed by a thin film made of a resinous material, such as polyethylene terephthalate (PET), polycarbonate (PC), polypropylene (PP), etc. The thickness of the thin film sheet 16 is set to, for example, 0.1 mm.

As clearly depicted in FIGS. 3 and 4, the housing 17 is provided with a pair of bearing portions 23 formed at the bottom surface of each of a pair of frame parts 17*a*, 17*a* constituting two opposing sides of the rectangular profile. In the illustrated embodiment, each bearing portion 23 is formed to pass through the frame part in a lateral or horizontal direction so as to communicate the inside and outside of the frame-like housing 17. On the other hand, each link member 13 includes a pair of arms 13*a*, 13*a* extending in a direction identical to and generally parallel to each other, and a trunk 13*b* integrally connected to the arms 13*a*, 13*a* and interconnecting the arms 13*a*, 13*a* with each other. The arms 13*a*, 13*a* are provided at the first ends thereof with cylindrical pivot axles 24, 24 formed to project coaxially with each other from the opposing inner sides of the arms 13*a* and parallel to the trunk 13*b*. The pivot axles 24, 24 are adapted to be pivotably received in the bearing portions 23 of the housing 17.

Figure 5:
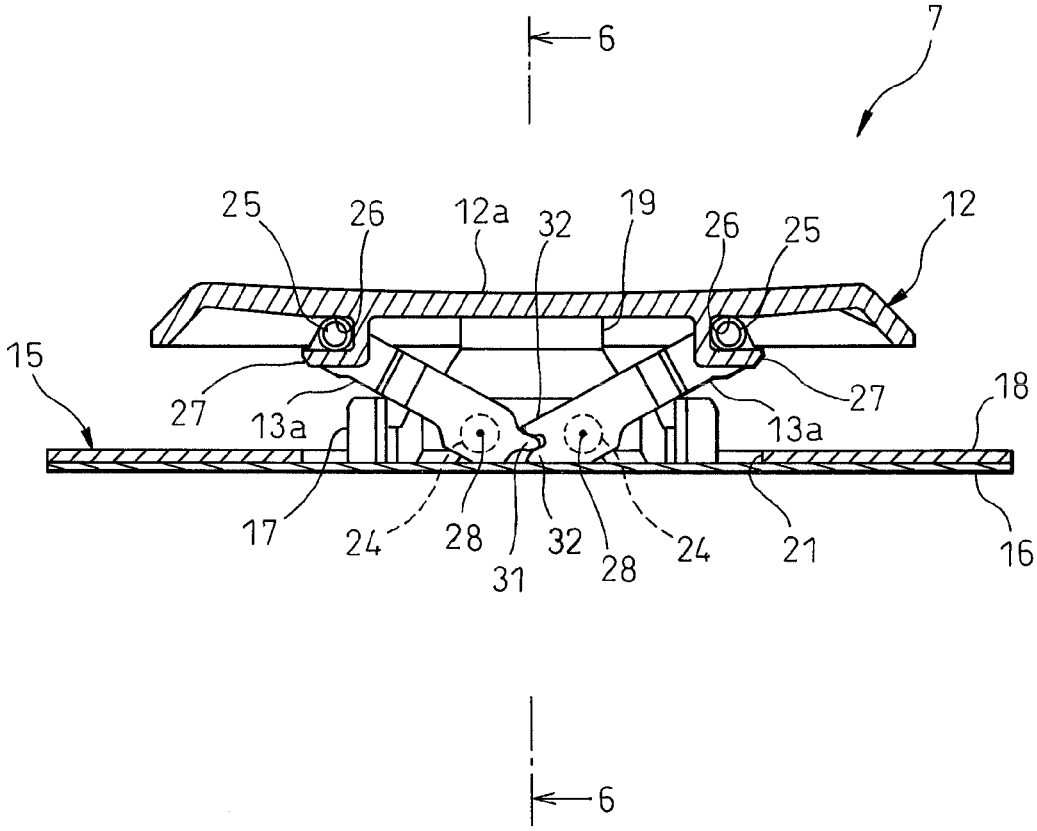
FIG. 5 is a cross-sectional view schematically depicting the key switch device according to the first embodiment.

FIG. 5 is a cross-sectional view schematically depicting the key switch device 7 according to the first embodiment. Referring to FIG. 5, the arms 13*a*, 13*a* are provided at the second ends thereof with slide axles 25, formed to project coaxially with each other from the mutually facing-away outer sides of the arms 13*a* and oppositely and parallel to the trunk 13*b*. The slide axles 25, 25 are slidably received respectively in a pair of guide grooves 26, 26 formed on the bottom or inner surface of the key top 12. Each guide groove 26 is formed on a protrusion 27 projecting from the bottom surface of the key top 12. As explained later, the link members 13, 13 can synchronously rotate about respective pivot axes 28, 28 defined by the pivot axles 24, 24 while accompanying the vertical motion of the key top 12.

In each link member 13, a single tooth 31 is formed on the first end of one arm 13*a*, and two teeth 32 are formed on the first end of the other arm 13*a*. The single tooth 31 of one link member 13 is meshed with the two teeth 32 of the other link member 13. The meshed engagement of the link members 13, 13 is maintained during the rotating motion of the link members 13, 13 caused by the vertical motion of the key top 12. As clearly depicted in FIG. 5, when the key top 12 is located at an initial or unoperated position, the key top 12 is received on the top of the rubber dome 19.

Figure 6:
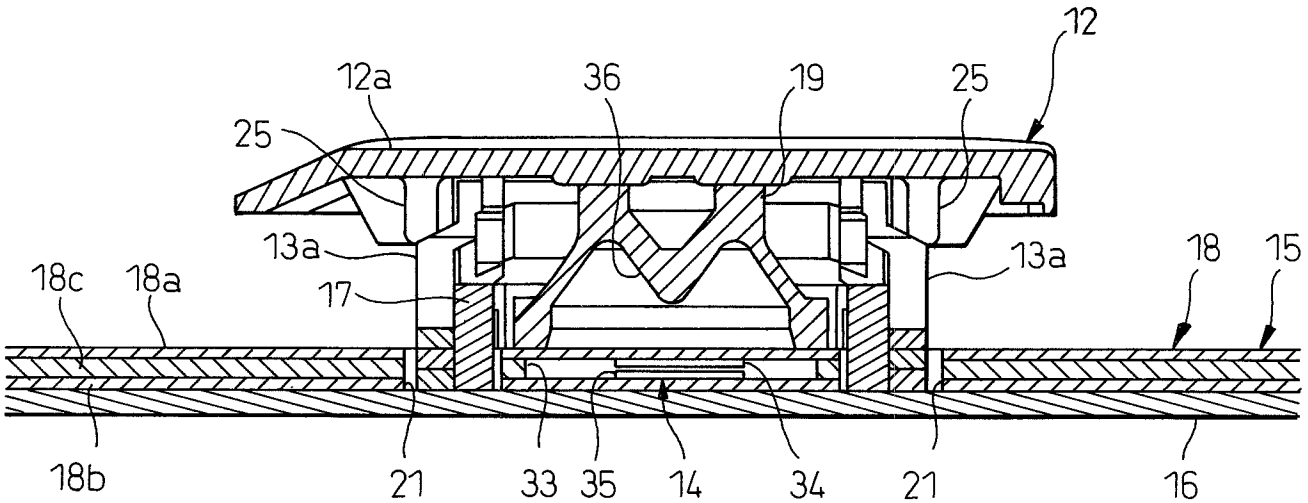
FIG. 6 is another cross-sectional view schematically depicting the key switch device according to the first embodiment.
Figure 7:
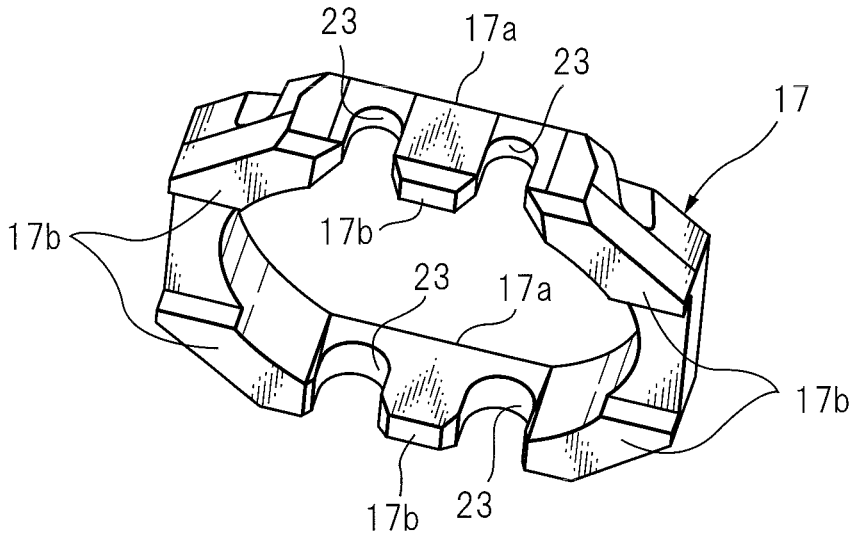
FIG. 7 is a perspective view schematically depicting a housing.

FIG. 6 is another cross-sectional view schematically depicting the key switch device 7 according to the first embodiment, and FIG. 7 is a perspective view schematically depicting the housing 17. Referring to FIGS. 6 and 7, a plurality of flat faces 17*b* extending in a common single plane are formed on the bottom surface of the housing 17. For example, the flat faces 17*b* are formed on the bottom surface of the housing 17 at areas corresponding to four corners of the frame-like housing 17 and areas between the bearing portions 23, 23 in the respective frame parts 17*a*, 17*a*. The housing 17 is bonded to the thin film sheet 16 at these flat faces 17*b*. As clearly depicted in FIG. 3, the adhesive 22 is applied to at least the regions of the top surface of the thin film sheet 16 for receiving the flat faces 17*b* of the housing 17.

The membrane sheet switch 18 includes an upper sheet 18*a* provided with a front or top surface adapted to receive the rubber dome 19 and an opposite back or bottom surface, a lower sheet 18*b* provided with a front or top surface facing the back surface of the upper sheet 18*a*, and a spacer sheet 18*c* interposed between the back surface of the upper sheet 18*a* and the front surface of the lower sheet 18*b*. The spacer sheet 18*c* is provided with a through hole 33 formed at a position corresponding to the rubber dome 19. A contact 34 is formed at the back surface of the upper sheet 18*a* at a position inside the through hole 33. A contact 35 is formed at the front surface of the lower sheet 18*b* at a position inside the through hole 33. The contacts 34, 35 face each other. The contacts 34, 35 are individually connected respectively to wiring patterns (not shown). The contacts 34, 35 constitute the aforementioned contact section 14.

The upper sheet 18*a*, the lower sheet 18*b* and the spacer sheet 18*c* may be bonded to each other by, for example, an adhesive (not shown). The upper sheet 18*a*, the lower sheet 18*b* and the spacer sheet 18*c* may be made of a plastic material, such as polyethylene terephthalate (PET). The rubber dome 19 may be attached to the top surface of the membrane sheet switch 18 by, for example, an adhesive. The contacts 34, 35 and wiring patterns may include a metal material, such as at least one of silver (Ag), copper (Cu) and aluminum (Al).

The situation where the user of the notebook personal computer 1 performs a key-entry operation so as to push down the key top 12, will be described below. When no external force is applied to the key top 12, the rubber dome 19 supports, by its top end, the key top 12 at the upper limit position of a key-entry stroke, in which the key top is spaced from the top surface of the membrane sheet switch 18 by a maximum distance. Thus, the key top 12 is positioned at an initial position. At this time, the contact section 14 of the membrane sheet switch 18 is in an opened state. The slide axle 25 of the link member 13 is held in the guide groove 26. The arms 13*a*, 13*a* of the link members 13, 13 represent an angled posture in which the arms mutually intersect at a predetermined minimum crossing angle as seen in a side view.

When the user applies an external force to the key top 12 and pushes down the key top 12, the downward motion of the key top 12 causes the link members 13, 13 to respectively rotate about the pivoting axes 28, 28 thereof in mutually opposite directions. The slide axles 25, 25 slide away from each other along the bottom surface of the key top 12. At this time, the rubber dome 19 elastically deforms and stores an elastic recovery force. When the key top 12 is positioned at the lower limit position of the key-entry stroke, in which the key top is spaced from the top surface of the membrane sheet switch 18 by a minimum distance, a projection 36 formed inside the rubber dome 19 presses the upper side contact 34 onto the lower side contact 35. The contact section 14 is thereby closed. At this time, the arms 13*a*, 13*a* of the link members 13, 13 represent an angled posture in which the arms mutually intersect at a predetermined maximum crossing angle as seen in a side view.

When the external force applied to the key top 12 is released, the rubber dome 19 recovers its original form due to its elastic recovery force, and thereby the key top 12 moves upward. Due to the upward motion of the key top 12, the link members 13, 13 respectively rotate about the pivoting axes 28, 28 thereof in mutually opposite directions. The slide axles 25, 25 slide toward each other along the bottom surface of the key top 12. When the rubber dome 19 recovers its original form, the key top 12 reaches the initial position. The slide axles 25, are respectively held in the guide grooves 26, 26. The arms 13*a*, 13*a* of the link members 13, 13 represent the angled posture in which the arms mutually intersect at the minimum crossing angle as seen in a side view. At this time, the contact section 14 is in an opened state.

In the above key-entry operation, while an external force is applied to the key top 12, the rubber dome 19 exerts an elastic recovery force on the key top 12, which assumes non-linear relationship with the downward displacement of the key top 12. As a result, the key switch device 7 can establish key-entry operation properties accompanied by a so-called click feeling, such that when the downward displacement of the key top 12 exceeds a predetermined value, the elastic recovery force, which has been gradually increased until that time, is abruptly reduced.

In the above keyboard 4, the housing 17 is attached to the thin film sheet 16 by, for example, the adhesive 22. The thin film sheet 16 is formed from, for example, a flexible resinous sheet, so that the thin film sheet 16 can be flexibly deformed at the time of, for example, assembling the keyboard 4 or incorporating the keyboard 4 into the notebook personal computer 1. As a result, the permanent deformation or breakage of the thin film sheet 16 can be avoided. The thin film sheet 16 does not require a high rigidity, so that the thickness of the thin film sheet 16 can be extremely reduced. Therefore, it is possible to provide a key switch device 7 or a keyboard 4, which can be reduced in weight and height, in comparison with a configuration in which a support plate formed from a metal material, such as a sheet metal or a stainless steel, is attached to a membrane sheet switch 18. Further, the keyboard 4 is received by the flat support plate 11 arranged inside the opening 6 of the main housing 2, so that, despite the thin film sheet 16 being flexible, an operation performance comparable with that of a conventional keyboard can be ensured.

Figure 8:
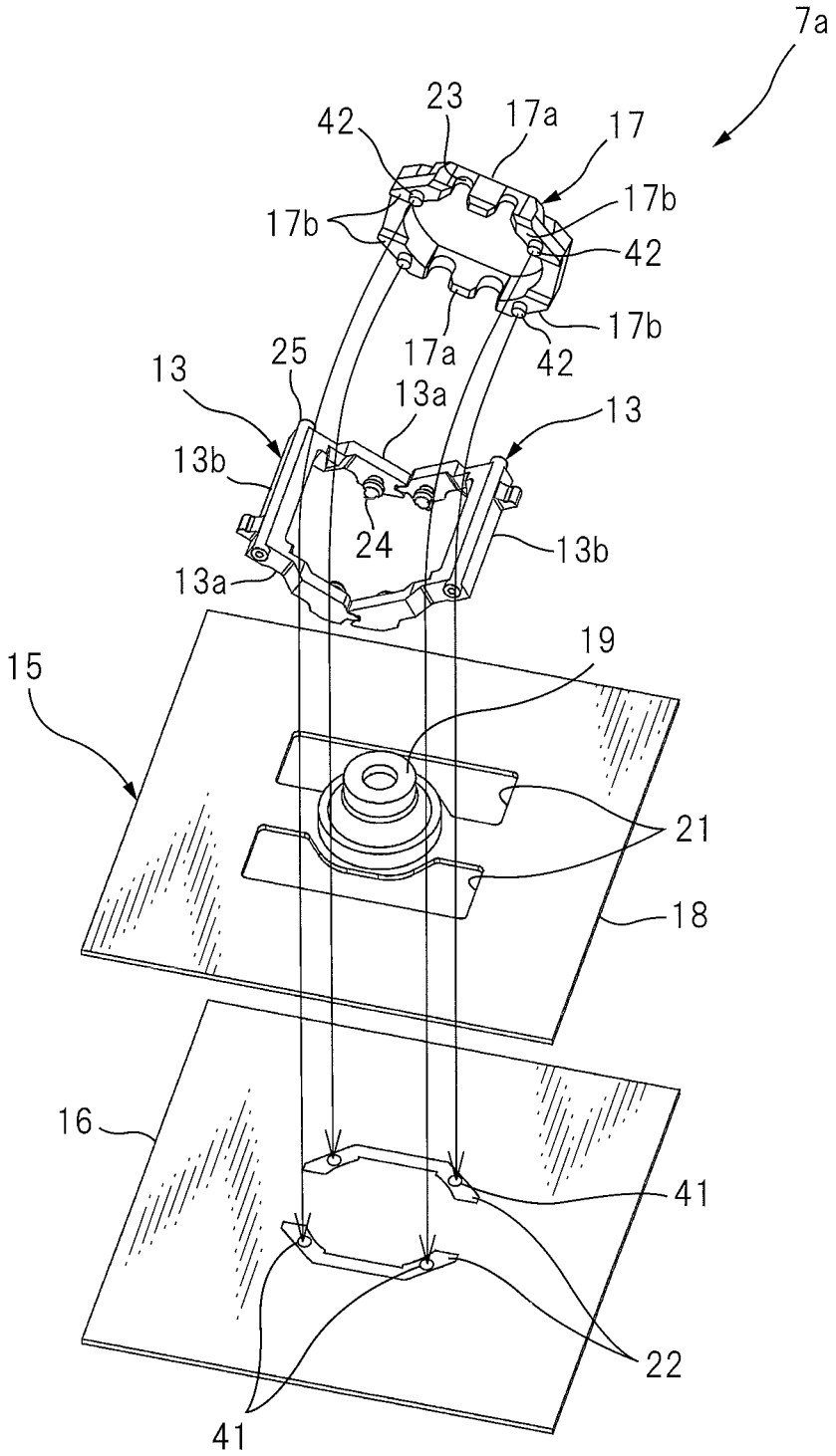
FIG. 8 is an exploded perspective view schematically depicting a key switch device according to a second embodiment.
Figure 9:
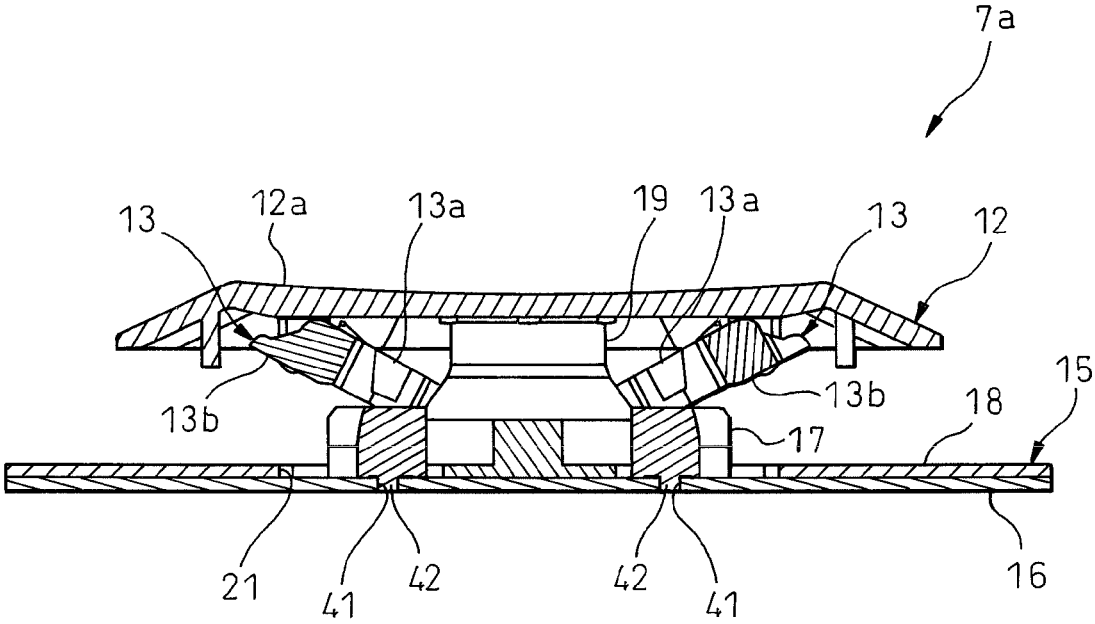
FIG. 9 is a cross-sectional view schematically depicting the key switch device according to the second embodiment.

FIG. 8 is an exploded perspective view schematically depicting a key switch device 7*a* according to a second embodiment. FIG. 9 is a cross-sectional view schematically depicting the key switch device 7*a* according to the second embodiment. In FIG. 8, a key top 12 is not depicted, and other components equivalent to the components of the first embodiment are denoted by the same reference numerals. In the key switch device 7*a*, a plurality of (e.g., four) through holes 41 are formed at surface regions on a flexible thin film sheet 16, to which an adhesive 22 is applied, so as to pass through the thin film sheet 16. On the other hand, on the flat faces 17*b* of a housing 17, a plurality of (e.g., four) projections 42 are formed at positions corresponding to the positions of the through holes 41, so as to project from the flat faces 17*b*. The through holes 41 and projections 42 are formed in cylindrical shapes. The projections 42 are arranged at, for example, the four corners of the frame-like housing 17.

As clearly depicted in FIG. 9, when the housing 17 is arranged on the thin film sheet 16, the projections 42 of the housing 17 are received in the through holes 41 of the thin film sheet 16. In this way, when the key switch device 7*a* is assembled, the housing 17 can be easily positioned on the thin film sheet 16. Thus, the key top 12 can be easily positioned on a membrane sheet switch 18. The flat faces 17*b* of the housing 17 are bonded to the thin film sheet 16 by the adhesive 22. The other configurations of the key switch device 7*a* are similar to those of the first embodiment, and therefore the explanations thereof are not repeated. According to the key switch device 7*a*, effects similar to those of the key switch device 7 can be realized.

Figure 10:
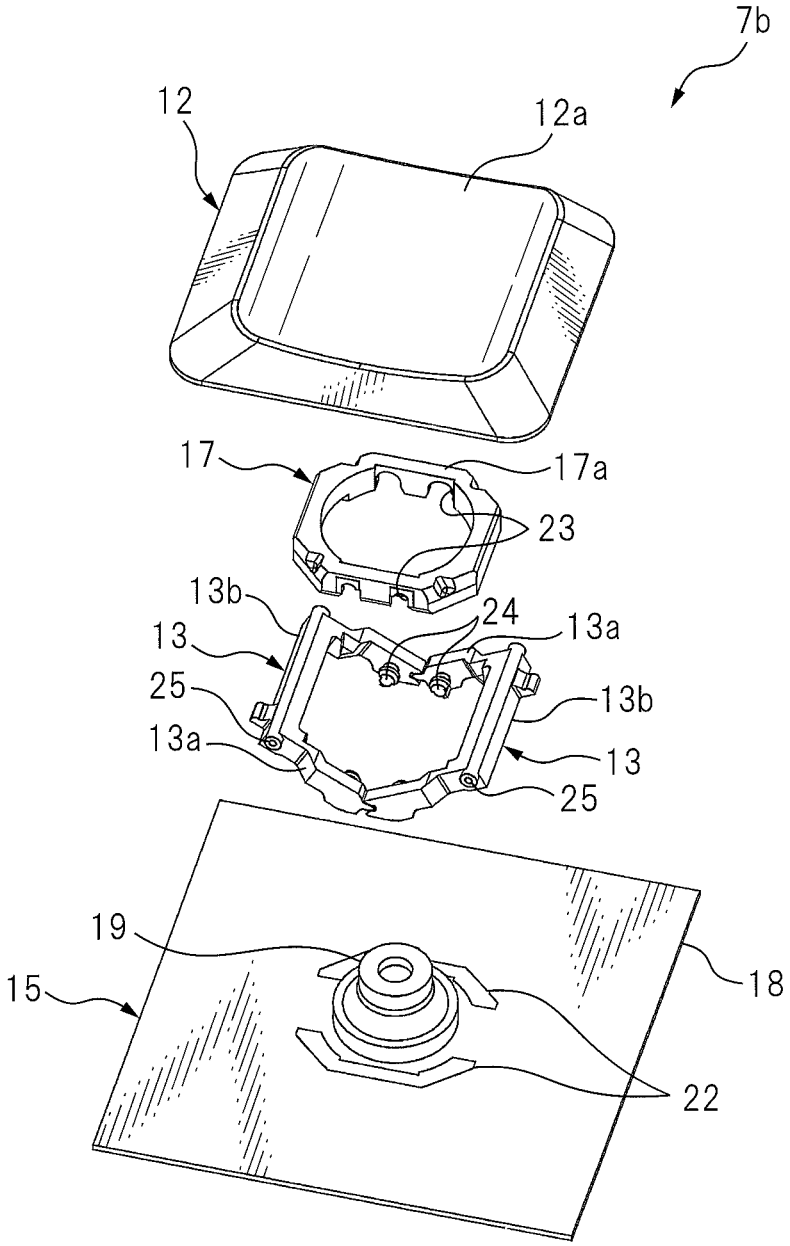
FIG. 10 is an exploded perspective view schematically depicting a key switch device according to a third embodiment.
Figure 11:
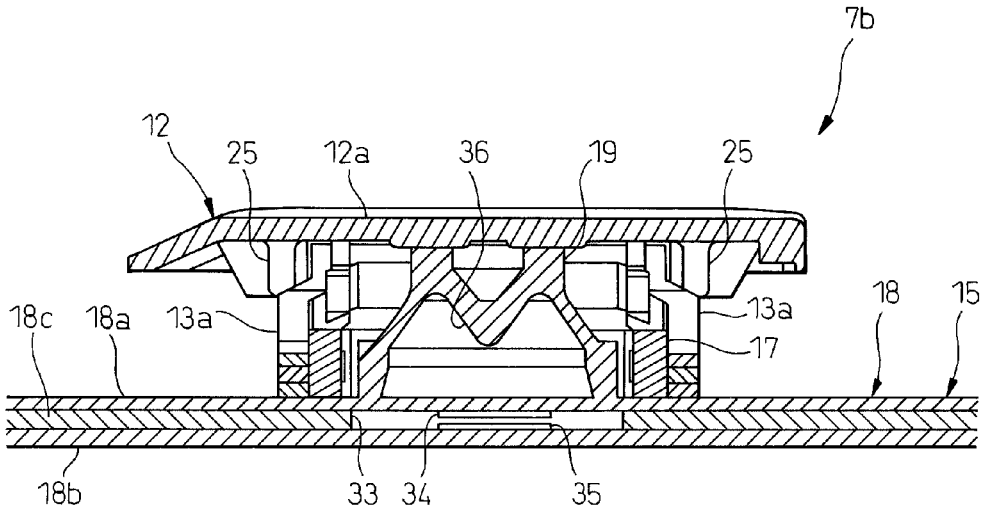
FIG. 11 is a cross-sectional view schematically depicting the key switch device according to the third embodiment.

FIG. 10 is an exploded perspective view schematically depicting a key switch device 7*b* according to a third embodiment. FIG. 11 is a cross-sectional view schematically depicting the key switch device 7*b* according to the third embodiment. Components equivalent to the components of the first embodiment are denoted by the same reference numerals. The key switch device 7*b* does not include the aforementioned thin film sheet 16. A housing 17 is attached, at its flat faces 17*b*, to the top surface of a membrane sheet switch 18, more specifically, the top surface of an upper sheet 18*a*, by, for example, an adhesive 22. The housing 17 is adapted to connect link members 13 to the membrane sheet switch 18. Thus, it is possible to omit to form the aforementioned relief holes 21, 21 in the membrane sheet switch 18. As a result, it is possible to easily manufacture the membrane sheet switch 18.

According to the key switch device 7*b*, the thin film sheet 16 and the relief holes 21 can be omitted, so that it is possible to reduce the number of components of the key switch device 7*b*. It is also possible to further reduce the weight and height of the key switch device 7*b* in comparison with the key switch devices 7, 7*a* by the thickness of the omitted thin film sheet 16. Furthermore, it is possible to reduce the manufacturing cost of the key switch device 7*b* and to simplify the configuration of the key switch device 7*b*. The keyboard 4 is received by the flat support plate 11 arranged inside the opening 6 of the main housing 2, so that, despite the membrane sheet switch 18 being flexible, an operation performance comparable with that of a conventional keyboard can be ensured.

Figure 12:
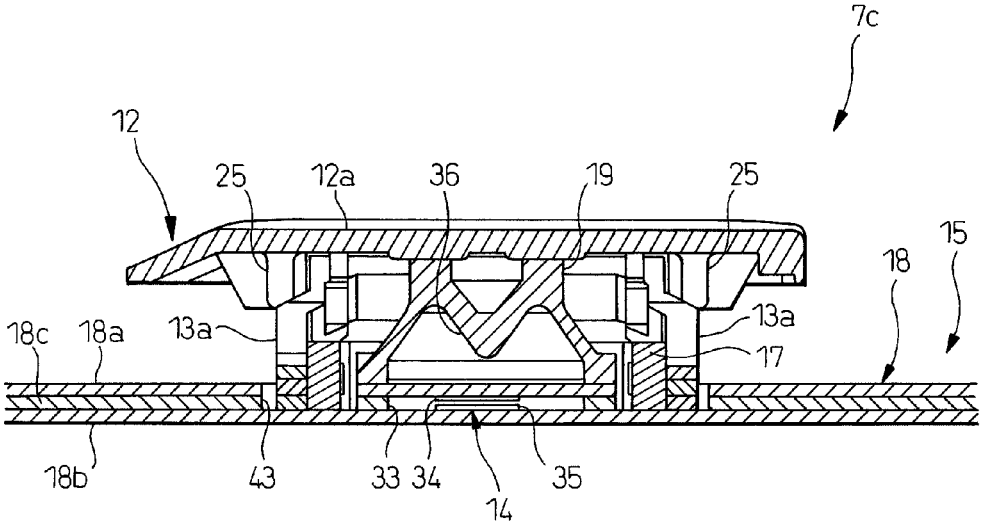
FIG. 12 is a cross-sectional view schematically depicting a key switch device according to a fourth embodiment.

FIG. 12 is a cross-sectional view schematically depicting a key switch device 7*c* according to a fourth embodiment. Components equivalent to the components of the first embodiment are denoted by the same reference numerals. In the key switch device 7*c*, relief holes 43 are formed in an upper sheet 18*a* and a spacer sheet 18*c* of a membrane sheet switch 18. The relief holes 43 are formed at, for example, positions around a contact section 14. The housing 17 is attached to the portions of the lower sheet 18*b* of the member sheet switch 18, which are exposed at the inside of the relief holes 43, by, for example, an adhesive. In the key switch device 7*c*, it is possible to reduce the height of the key switch device 7*c*, and therefore the height of the keyboard 4, by the thicknesses of the upper sheet 18*a* and the spacer sheet 18*c*. As a result, the key switch device 7*c* can further reduce the height of the keyboard 4, in comparison with the key switch device 7*b*.

In the above key switch devices 7, 7*a*, 7*b* and 7*c*, the housing 17 may be attached to the thin film sheet 16 or the membrane sheet switch 18 by using, for example, ultrasonic vibration, instead of the adhesive 22, so as to weld the flat faces 17*b* of the housing 17 to the thin film sheet 16 or the membrane sheet switch 18.

Figure 13:
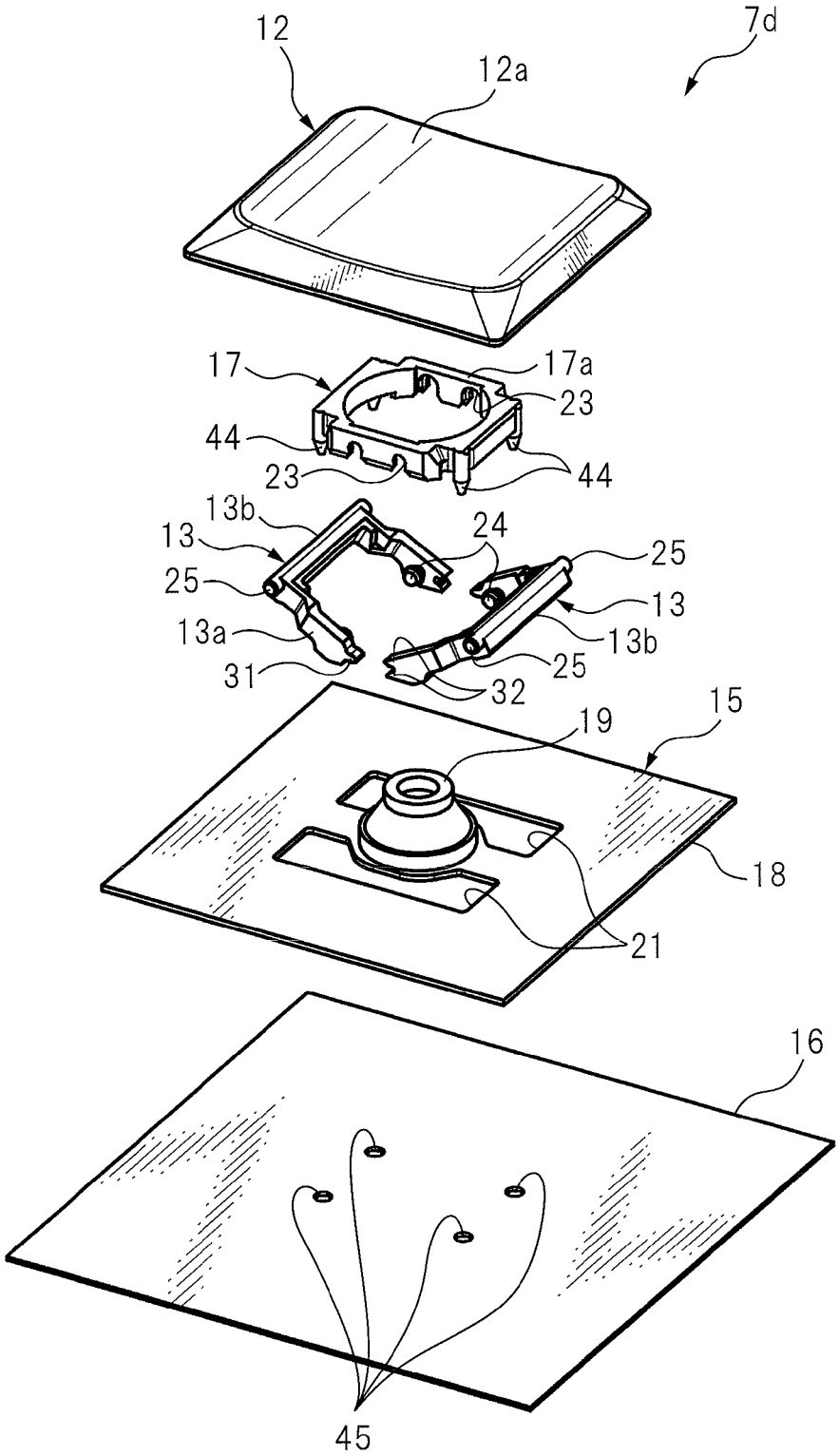
FIG. 13 is an exploded perspective view schematically depicting a key switch device according to a fifth embodiment.
Figure 14:
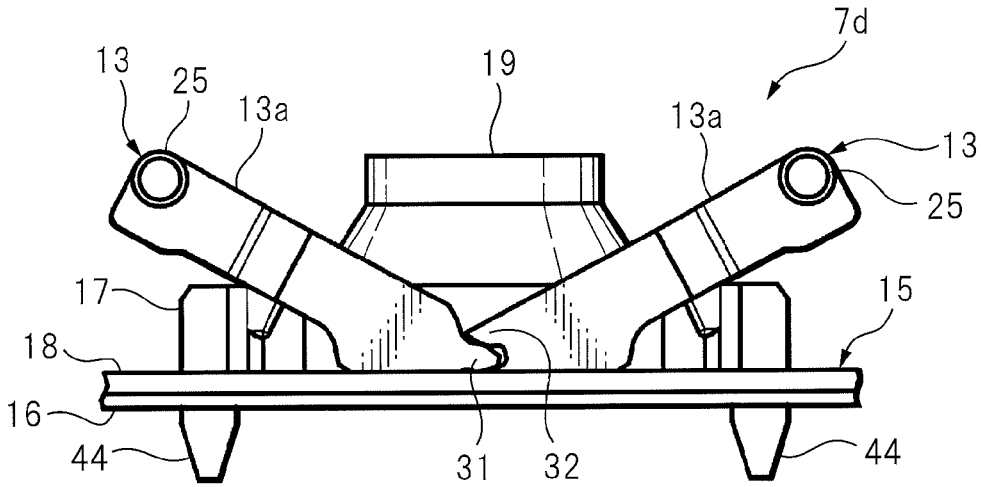
FIG. 14 is a side view schematically depicting a part of the key switch device according to the fifth embodiment, in an incompletely assembled state.
Figure 15:
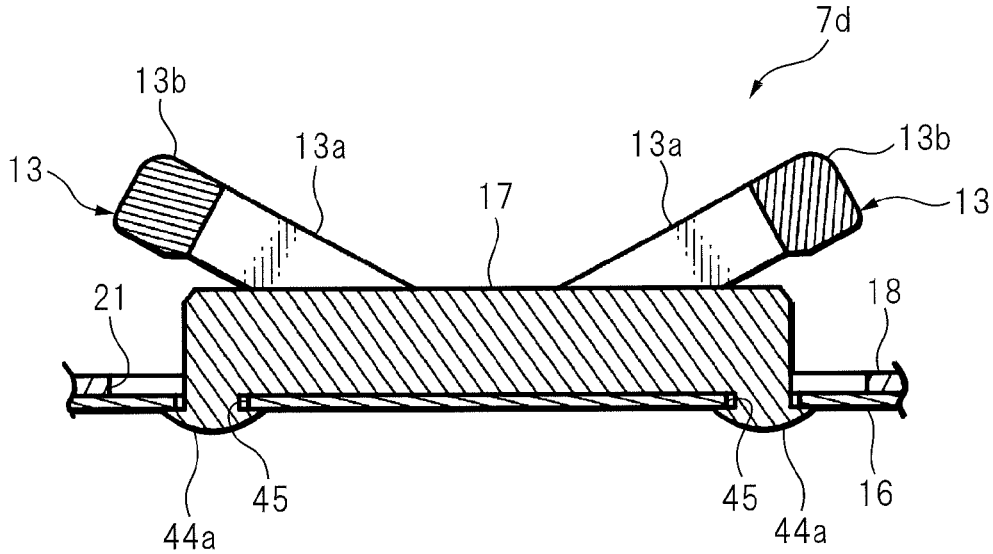
FIG. 15 is a cross-sectional view schematically depicting a part of the key switch device according to the fifth embodiment, in a completely assembled state.

FIG. 13 is an exploded perspective view schematically depicting a key switch device 7*d* according to a fifth embodiment, in which a housing 17 has an initial or undeformed shape. FIG. 14 is a side view schematically depicting a part of the key switch device 7*d* according to the fifth embodiment, in an incompletely assembled state. FIG. 15 is a cross-sectional view schematically depicting a part of the key switch device 7*d* according to the fifth embodiment, in a completely assembled state. Components equivalent to the components of the first embodiment are denoted by the same reference numerals. In the key switch device 7*d*, as clearly depicted in FIG. 13, the housing 17 of the initial shape is provided with a plurality of (e.g., four) legs 44 projecting toward a thin film sheet 16 at, for example, the four corners of the housing. The leg 44 is formed in, for example, a frustoconical shape tapered toward the tip thereof. On the other hand, through holes 45 are formed in the thin film sheet 16 at positions corresponding to the legs 44 so as to pass through the thin film sheet 16.

The housing 17 is attached to the thin film sheet 16 by thermal caulking, in which the tips of the legs 44 are melted and deformed by heat. As depicted in FIG. 14, before performing the thermal caulking, the legs 44 of the housing 17 are received in the through holes 45 of the thin film sheet 16. The tips of the legs 44 penetrate through the through holes 45 and project from the bottom surface of the thin film sheet 16. In this state, the tips of the legs 44 are melted by heat. As a result, as depicted in FIG. 15, the tips of the legs 44 are deformed to provide deformed portions 44*a* extending along the bottom surface of the thin film sheet 16. Due to the deformed portions 44*a*, the housing 17 is simply and stably attached to the thin film sheet 16. In the aforementioned key switch device 7*b*, in which the thin film sheet 16 is omitted, through holes 45 may be formed in the membrane sheet switch 18. The housing 17 is thereby simply and stably attached to the membrane sheet switch 18.

Figure 16:
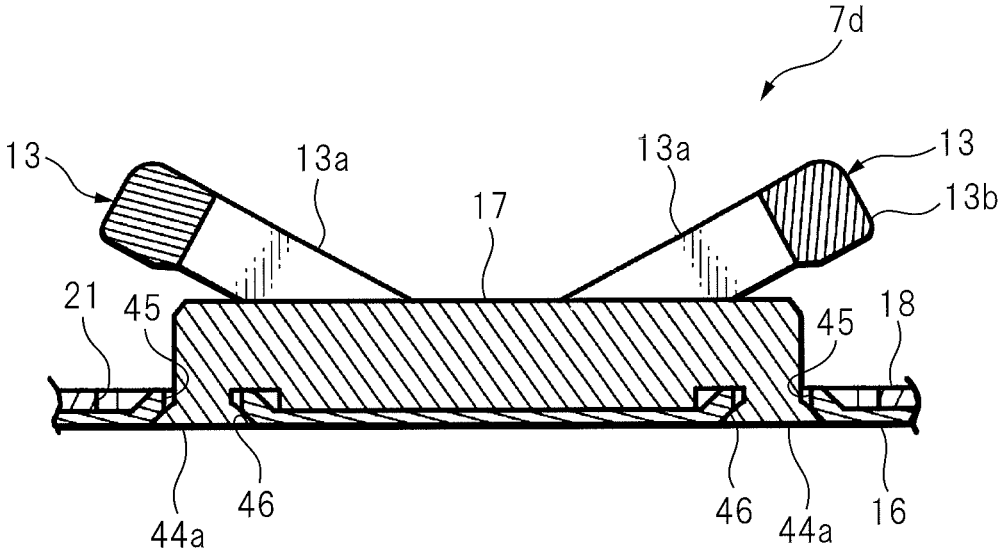
FIG. 16 is a cross-sectional view schematically depicting a modification of a part of the completely assembled key switch device according to the fifth embodiment.

As depicted in FIG. 16, the thin film sheet 16 may be provided with recesses 46 formed to receive the deformed portions 44*a* of the legs 44. In this case, the through holes 45 are formed in the recesses 46. According to this configuration, it is possible to prevent the deformed portions 44*a* from projecting from the bottom surface of the thin film sheet 16. As a result, it is possible to further reduce the height of the key switch device 7, and therefore the height of the keyboard 4.

Figure 17:
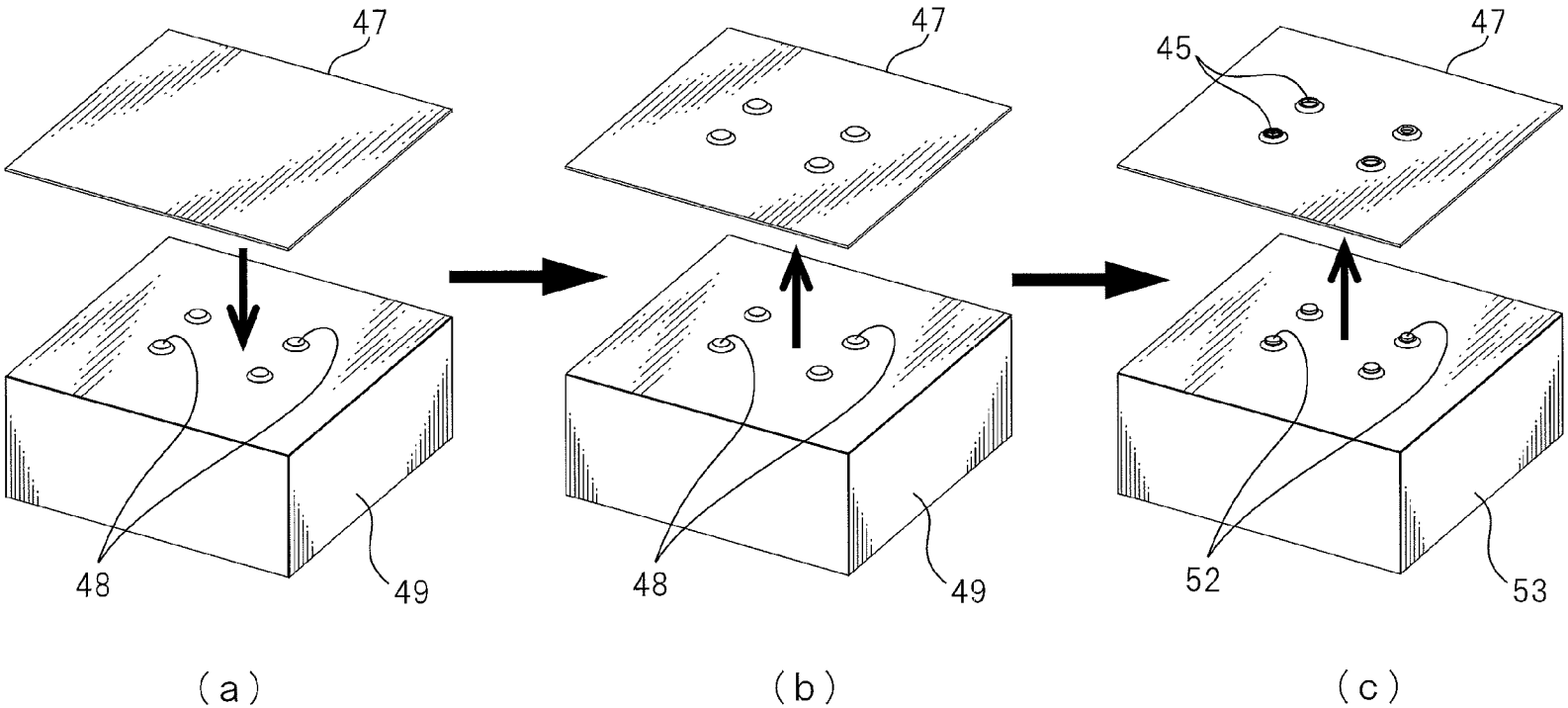
FIG. 17 is a perspective view depicting several steps of a process for forming a thin film sheet.

The recesses 46 may be formed in the thin film sheet 16 through, for example, a process depicted in FIG. 17. In step (a), a resinous sheet 47 is pressed against the top surface of a punch 49 provided with bumps 48, the shapes of which correspond to the contours of the recesses 46. In step (b), depressions 51 are formed in the resinous sheet 47 by the bumps 48, and the resinous sheet 47 with depressions 51 is removed from the punch 49. In step (c), the resinous sheet 47 with depressions 51 is pressed against the top surface of a punch 53 provided with bumps 52 for forming the through holes 45 in the depressions 51, and the resinous sheet 47 with depressions 51 and through holes 45 is removed from the punch 53. In this way, a thin film sheet 16 provided with the recesses 46 and the through holes 45 is obtained. In this connection, the thermal caulking as means for attaching the housing 22 may also be applied to the aforementioned key switch devices 7, 7*a*, 7*b* and 7*c*.

Figure 18:
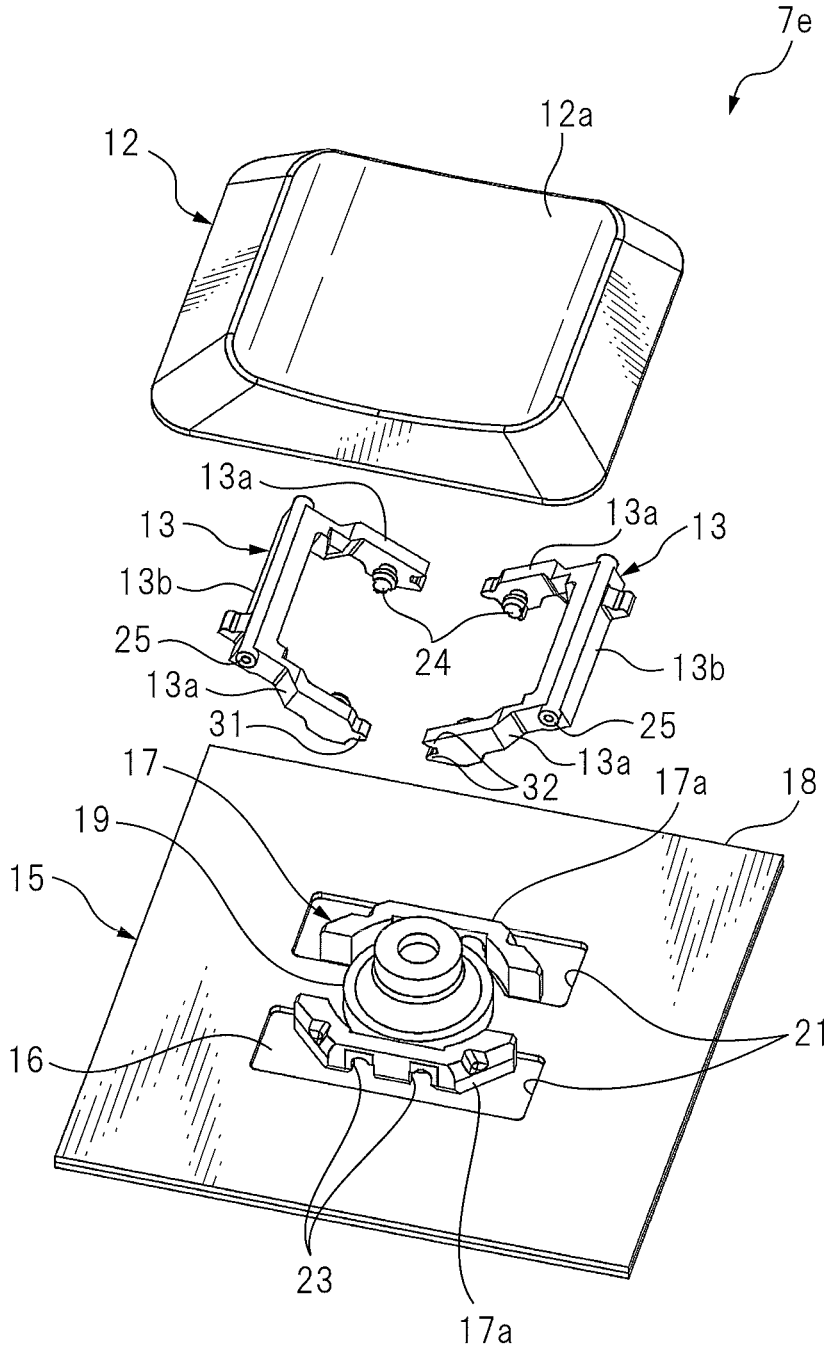
FIG. 18 is an exploded perspective view schematically depicting a key switch device according to a sixth embodiment.
Figure 19:
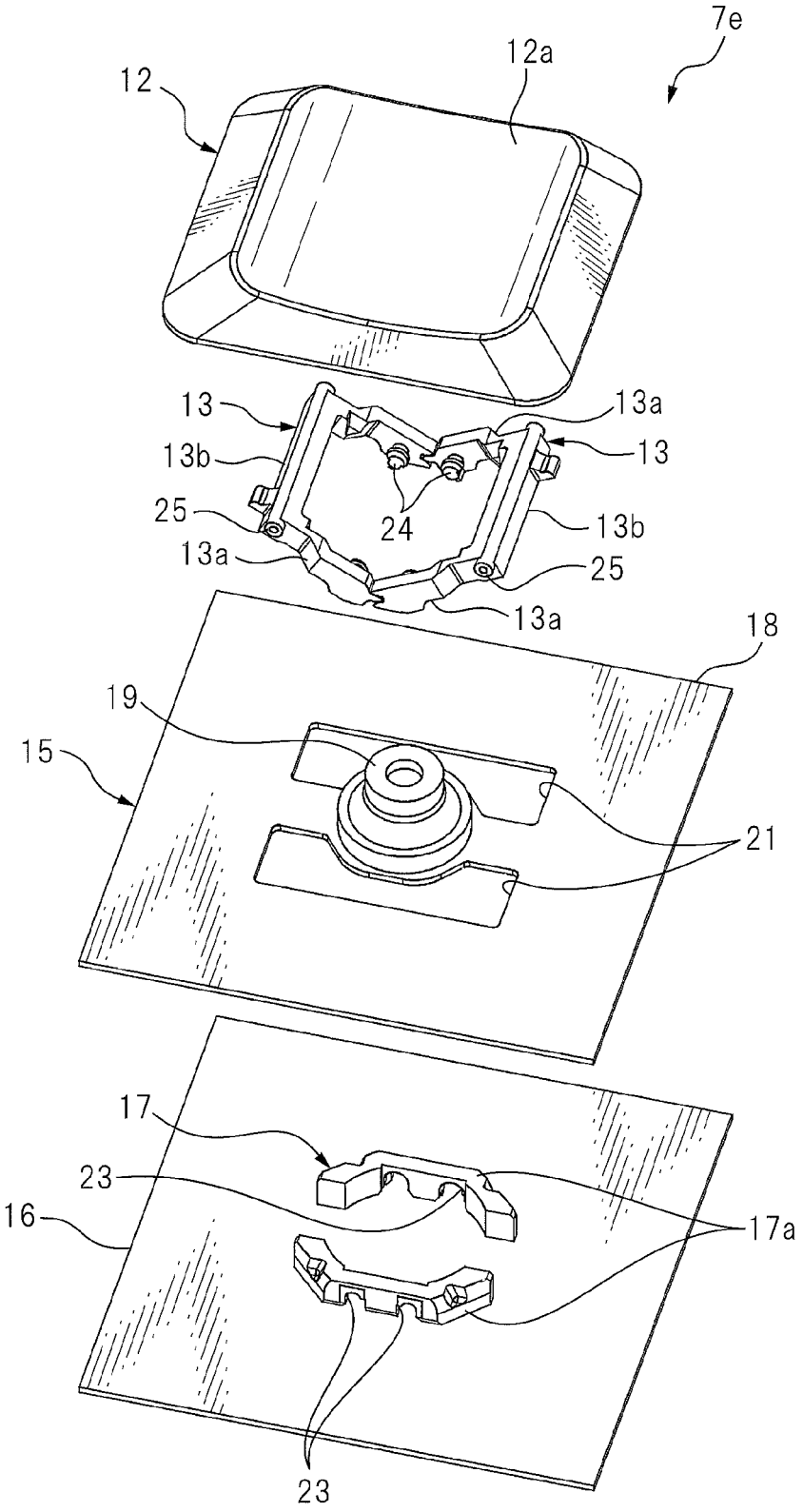
FIG. 19 is another exploded perspective view schematically depicting the key switch device according to the sixth embodiment.

FIG. 18 and FIG. 19 are exploded perspective views schematically depicting a key switch device 7*e* according to a sixth embodiment. Components equivalent to the components of the first embodiment are denoted by the same reference numerals. As depicted in FIG. 18, in the key switch device 7*e*, a housing 17 is divided into a pair of frame parts 17*a*, 17*a*. The frame parts 17*a*, 17*a* are bonded respectively to portions of a thin film sheet 16, exposed at the inside of relief holes 21, 21 of a membrane sheet switch 18, by an adhesive. The other configurations of the key switch device 7*e* are similar to those of the key switch device 7, and therefore the explanations thereof are not repeated.

As depicted in FIG. 19, the key switch device 7*e* may be assembled through an outsert molding process of the frame parts 17*a*, 17*a* of the housing 17 performed on the thin film sheet 16. More specifically, during the molding process of the housing 17, the thin film sheet 16 is bonded to the housing 17. According to the outsert molding, it is possible to easily attach the housing 17 to the thin film sheet 16. After the outsert molding, a switch mechanism 15 is mounted to the thin film sheet 16. The frame parts 17*a*, 17*a* are received in the relief holes 21, 21 of the membrane sheet switch 18. After that, pivot shafts 24, 24 of link members 13, 13 are fitted into bearing portions 23, 23 of the frame parts 17*a*, 17*a* by, for example, the elastic deformation of the link members 13, 13.

Various changes or modifications may be made in the inventive key switch. For example, in the above key switch devices 7, 7*a*, 7*d* and 7*e*, the thin film sheet 16 may be formed from an organic EL (electroluminescence) sheet. An organic EL sheet includes a light emitting layer. Due to the function of the light emitting layer, the organic EL sheet can emit light. In the key switch devices 7, 7*a*, 7*d* and 7*e*, the key top 12 may be formed from, for example, a transparent resinous material. The transparent plastic material may be painted, and thereafter, a portion of paint, corresponding to a letter or symbol, may be peeled off by etching. In this way, only the letter or symbol on a key top 12 can emit light due to the light emission of the organic EL sheet. In a keyboard 4 including the key switch device 7, 7*a*, 7*d* or 7*e* with the organic EL sheet, it is possible to improve the visual recognition of the key top by a user at the time of operation in a dark location.

Figure 20:
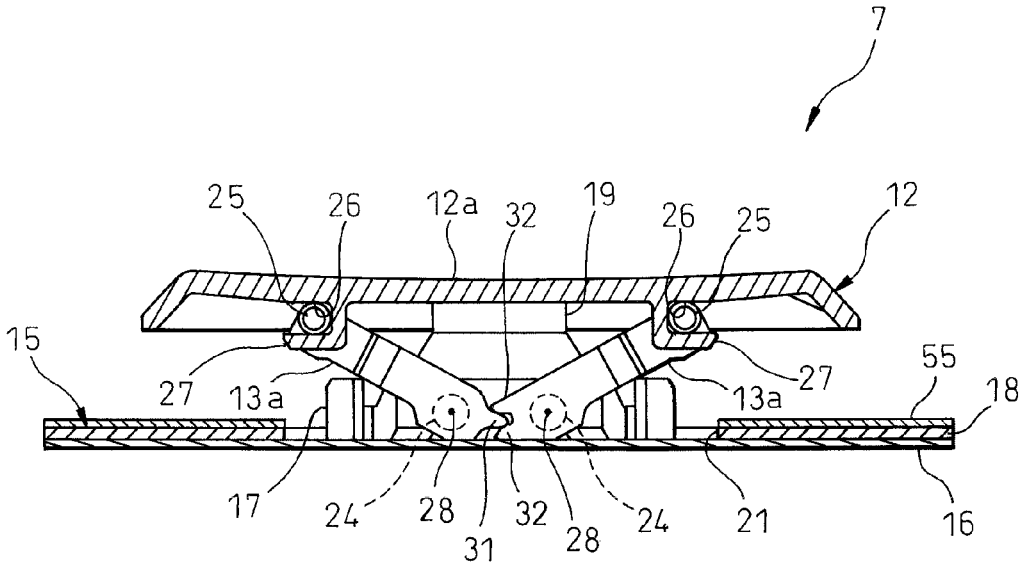
FIG. 20 is a cross-sectional view schematically depicting a modification of a key switch device according to an embodiment.

As depicted in FIG. 20, in the key switch device 7, for example, an anti-static layer 55 may be formed on the surface of the membrane sheet switch 18. The anti-static layer 55 may be made of, for example, a surfactant or other known anti-static agent. The anti-static layer 55 may be formed by, for example, applying the anti-static agent to the surface of the membrane sheet switch 18. In this key switch device 7, the anti-static layer 55 can act to suppress the generation of static electricity in the keyboard 4. The anti-static layer 55 can also act to disperse any static electricity generated in the keyboard 4 into the atmosphere. As a result, it is possible to prevent the static electricity from flowing through the wiring patterns of the membrane sheet switch 18. It is also possible to reduce the occurrence of noise at the wiring patterns. The anti-static layer 55 may be similarly incorporated in the key switch devices 7*a* to 7*e*.

Further, in the key switch device 7, for example, a conductive layer (not shown) may be formed on the surface of the membrane sheet switch 18, instead of the aforementioned anti-static layer 55. The conductive layer may be made of, for example, a paint of silver (Ag), carbon (C) or other conductive material. The conductive layer may be formed by, for example, applying a paint of a paste-like conductive material to the surface of the membrane sheet switch 18. In this key switch device 7, the conductive layer can function as a ground for the membrane sheet switch 18. Thus, the static electricity generated in the keyboard 4 can flow through the conductive layer. As a result, it is possible to prevent the static electricity from flowing through the wiring patterns of the membrane sheet switch 18. It is also possible to reduce the occurrence of noise at the wiring patterns. The conductive layer may be similarly incorporated in the key switch devices 7*a* to 7*e*.

Figure 21:
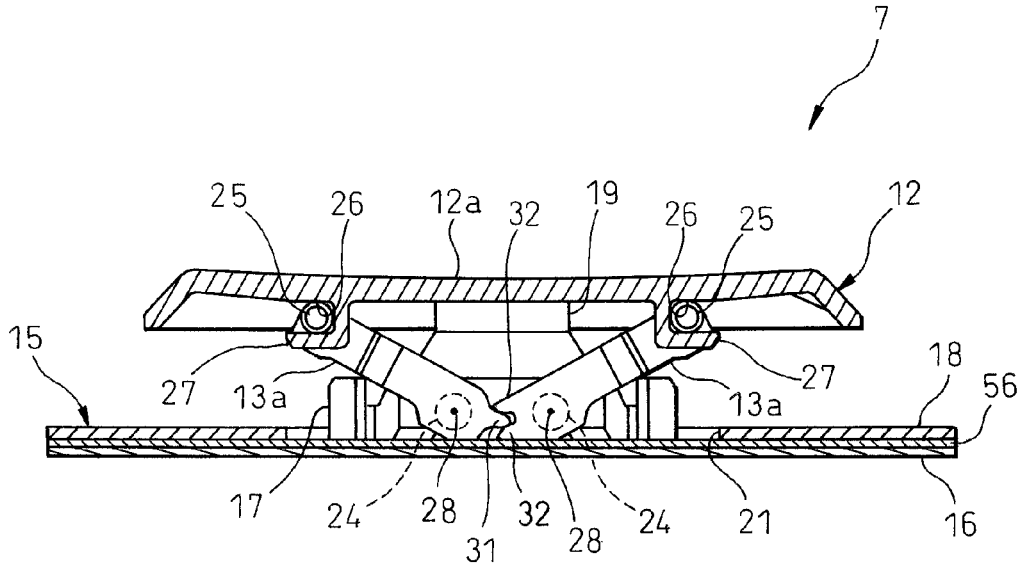
FIG. 21 is a cross-sectional view schematically depicting another modification of a key switch device according to an embodiment.

As depicted in FIG. 21, in the key switch device 7, for example, a conductive layer 56 may be formed on the surface of the thin film sheet 16. More specifically, the conductive layer 56 may be formed between the top surface of the thin film sheet 16 and the back surface of the membrane sheet switch 18. The conductive layer 56 may be made of, for example, aluminum (Al), copper (Cu) or other conductive material. The conductive layer 56 may be formed by, for example, applying a conductive material through a vapor depositing to the surface of the thin film sheet 16, or attaching a sheet with a conductive material applied thereto through a vapor depositing. In this key switch device 7, the conductive layer 56 can function as a ground for the membrane sheet switch 18. Thus, the static electricity generated in the keyboard 4 can flow through the conductive layer 56. As a result, it is possible to prevent the static electricity from flowing through the wiring patterns of the membrane sheet switch 18. It is also possible to reduce the occurrence of noise at the wiring patterns. The conductive layer 56 may be similarly incorporated in the key switch devices 7*a* to 7*e*. Further, the conductive layer 56 may be used, for example, together with the aforementioned anti-static layer 55, and/or the aforementioned conductive layer formed on the membrane sheet switch 18.

While the invention has been described with reference to specific embodiments, it will be understood by those skilled in the art that various changes and modifications may be made thereto without departing from the scope of the following claims.

The invention claimed is:

1. A key switch device comprising:

a key top;

a pair of link members connected to said key top, said pair of link members interlocked with each other to guide a vertical motion of said key top;

a switch mechanism including a membrane sheet switch capable of opening and closing a contact section of an electrical circuit in accordance with the vertical motion of said key top, the membrane sheet switch having a hole formed therein;

a flexible thin film sheet attached to and disposed beneath said membrane sheet switch, the flexible thin film sheet being deformable; and a housing attached to said thin film sheet through the hole, said housing adapted to connect said link members to said thin film sheet.

2. The key switch device of claim 1, further comprising:

a through hole formed in said thin film sheet so as to pass through said thin film sheet; and a projection formed on said housing so as to project from said housing, said projection adapted to be received in said through hole.

3. The key switch device of claim 1, wherein said housing is attached to said thin film sheet by any of an adhesive, ultrasonic vibration, thermal caulking, and outsert molding.

4. The key switch device of claim 1, wherein said thin film sheet comprises an organic EL sheet.

5. The key switch device of claim 1, further comprising an anti-static layer made of an anti-static agent and formed on a surface of said membrane sheet switch.

6. The key switch device of claim 1, further comprising a conductive layer made of a conductive material and formed on at least one of a surface of said membrane sheet switch and a surface of said thin film sheet.

7. A keyboard comprising a plurality of key switch devices, each key switch device being defined in claim 1.

8. A key switch device comprising:

a key top;

a pair of link members connected to said key top, said pair of link members interlocked with each other to guide a vertical motion of said key top;

a switch mechanism including a membrane sheet switch capable of opening and closing a contact section of an electrical circuit in accordance with the vertical motion of said key top; and a housing attached to said membrane sheet switch, said housing adapted to connect said link members to said membrane sheet switch, wherein said membrane sheet switch comprises:

a lower sheet provided with a front surface;

an upper sheet provided with a back surface facing said front surface of said lower sheet;

a spacer sheet interposed between said front surface of said lower sheet and said back surface of said upper sheet; and a relief hole formed in said upper sheet and said spacer sheet so as to pass through said upper sheet and said spacer sheet, said housing being attached to a portion of said lower sheet exposed at an inside of said relief hole.

9. The key switch device of claim 8, wherein said housing is attached to said membrane sheet switch by any of an adhesive, ultrasonic vibration, thermal caulking, and outsert molding.

10. The key switch device of claim 8, further comprising an anti-static layer made of an anti-static agent and formed on a surface of said membrane sheet switch.

11. The key switch device of claim 8, further comprising a conductive layer made of a conductive material and formed on a surface of said membrane sheet switch.

12. A keyboard comprising a plurality of key switch devices, each key switch device being defined in claim 8.

13. The key switch device of claim 1, wherein said housing includes a pair of separate frame parts, each frame part being attached to said flexible thin film sheet through said hole.

* * * * *